United States Patent [19]

Pöll

[11] 4,323,611

[45] Apr. 6, 1982

[54] DECORATIVE MATERIAL AND A PROCESS FOR PRODUCING THE SAME

[75] Inventor: Martin Pöll, Fritzens, Austria

[73] Assignee: D. Swarovski & Co., Osterreich, Austria

[21] Appl. No.: 110,613

[22] Filed: Jan. 9, 1980

[30] Foreign Application Priority Data

Jan. 17, 1979 [DE] Fed. Rep. of Germany ..... 2901728

[51] Int. Cl.[3] ..... B44C 1/26; B44C 1/28; B44C 3/12

[52] U.S. Cl. ..... 428/67; 63/26; 63/28; 156/298; 428/78; 428/79; 428/24; 428/241; 428/255

[58] Field of Search ..... 428/67, 78, 79, 240, 428/241, 255; 63/28, 26; 156/298, 309

[56] References Cited

U.S. PATENT DOCUMENTS 2,750,300 6/1956 Kukoff ..... 428/67
4,052,863 10/1977 Pöll ..... 428/67

*Primary Examiner*—Marion McCamish
*Attorney, Agent, or Firm*—Bacon & Thomas

[57] ABSTRACT

A decorative material consisting of decorative elements which are arranged in a pattern on a flat backing is described, said backing consisting of a thin, wide-mesh net on which said decorative elements are arranged with the side bearing said fusion adhesive coating facing towards said backing and said fusion adhesive coating penetrating through the mesh of said backing. In particular, cut paste and small rhinestones are employed as said decorative material.

The decorative elements are suitable for many different applications, in particular for adorning and embellishing textiles and articles of clothing.

4 Claims, 4 Drawing Figures

DECORATIVE MATERIAL AND A PROCESS FOR PRODUCING THE SAME

BACKGROUND OF THE INVENTION

This invention relates to a decorative material and to a process for producing the same.

The decorative material consists of a plurality of discrete decorative elements which are arranged in a pattern on a support or backing. This decorative material is especially suitable for adorning or embellishing clothing, bags, belts and shoes.

DESCRIPTION OF THE PRIOR ART

Numerous decorative materials have been described, all of which suffer from drawbacks with respect to their use and manufacture.

Austrian patent specification No. 260,591 describes decorative materials which consist of a web-like fabric on which there are figurative thermoplastic bodies forming in particular mountings for rhinestones, the plastic bodies being interconnected by plastic webs and having at the rear projections which penetrate through the fabric to be anchored at the back by upsetting them similar to a rivet. The manufacture of these decorative elements is expensive and in many applications the mountings and plastic webs act to impair the overall appearance.

German patent specification No. 2,452,250 recites components which are studded with gemstones. The individual stones are surrounded in relief by a fusion adhesive foil. Such gemstone-studded components are hardly suitable for adorning textiles, since fusion adhesive foil is provided between the individual gemstones, when these are disposed in spaced relation, and thus does not provide a good optical impression on the textile.

Finally, German laying-open print DE-OS No. 2,541,633 teaches a multilayer system for decorating flat structure in which the individual decorative elements have a fusion adhesive coating on the one side and on the opposite side are affixed by adhesion to a backing material in a patterned configuration. After affixing the individual decorative elements to the desired substrate by means of the activated fusion adhesive, the backing material is removed. This know system is particularly disadvantageous because the adhering plastic foil which is used as the backing and which must be thermally stable at the temperature at which the adhesive is activated, constitutes a considerable expense factor. This known system is also disadvantageous because, when employed on embroidered fabrics, removal of the backing material may cause damage to the embroidery.

SUMMARY OF THE INVENTION

The object of the invention is to provide a decorative material which is especially suitable for adorning and embellishing articles of clothing and the like, has a simple structure, does not use any expensive backing materials and is easy to manufacture and apply.

This object is accomplished by a decorative material consisting of decorative elements which are arranged on a flat backing in a pattern and which have a fusion adhesive coating, characterized in that the backing consists of a thin, wide-mesh net on which the decorative elements are arranged with the side bearing the fusion adhesive coating facing towards the backing and the fusion adhesive coating penetrates through the backing mesh.

The invention also covers a process for producing a decorative material consisting of decorative elements arranged on a flat backing in a pattern, characterized in that the decorative elements are provided with a fusion adhesive coating, the elements are arranged in a pattern on an auxiliary backing and thereafter a backing consisting of a thin, wide-mesh net is brought into contact with the decorative elements arranged on the auxiliary backing at a temperature at which the fusion adhesive is activated.

The inventive decorative elements are characterized by a simple structure and the use of an expensive backing material is avoided. The manufacture, which will be discussed in detail hereinbelow, is simple and economical. The application of the decorative material is extremely easy. The decorative material is placed on the article to be embellished and the fusion adhesive coating is activated by supplying heat and forms a bond. The wide-mesh net which is employed as the backing is also advantageous because the decorative elements can be arranged in one position or another and held in place with a few stiches before being finally attached. Owing to the net-like backing which is employed, it is also possible to sew the decorative elements to the fabric which is advantageous if they are to be removed later. In particular, it is no longer necessary to remove a backing foil and, consequently, there is no risk of damaging any embroidery which may be present.

The elements for the decorative material in accordance with the invention can be in particular small, cut glass stones, generally termed paste or strass, as well as disks, rivets and other structures of metal and plastic.

All known fusion adhesives which ensure good adhesion between the decorative elements and the articles to which they are to be affixed are suitable as the fusion adhesive coating. Examples of such fusion adhesives are polyamides, polyvinyl acetate, polyester resins, epoxy resins, isocyanates and aminoplasts. Thermoplastic polyamide resin-base fusion adhesives are especially preferred.

The backing material consists of a thin, wide-mesh net. The term net is understood in this context to also mean woven fabric, knitted fabric and the like. Especially suitable are tulle- and canvas-like structures. The backing can be of textile, metallic or plastic material. Polyamide nets are especially advantageous. It goes without saying that the mesh of the net should be smaller than the individual decorative elements so that these do not fall through the net. On the other hand, however, it is advantageous to use, if possible, wide-mesh nets through which the fusion adhesive penetrates easily and which have the least optically disruptive appearance. In most cases it is advisable to choose the color of the backing to match that of the article on which the decorative material is to be applied in order to optically suppress the backing. The material used for the backing should withstand the activating temperature of the fusion adhesive. High-strength material is preferred. An unstretchable net material is best for most applications. Stretchable materials, however, can also be considered for certain applications. The net should consist of the thinnest possible threads so that the thickness of the fusion adhesive coating can be kept as low as possible as well as for optical reasons.

For a decorative material in which the decorative elements are arranged in one row only, the net-like backing material consists merely of one or two parallel threads.

The decorative material can be supplied for processing in the form of web material. Alternately, individual element groups and ornaments can be cut out of the flat or web-like decorative material and used as such.

When manufacturing the decorative material, the individual decorative elements are generally provided first on a side opposite the visible side in a customary manner using a fusion adhesive coating. In order to arrange the decorative elements in a pattern on the backing, it is advantageous to make use of an auxiliary backing material. The decorative elements are positioned in the desired arrangement preferably on a template which can be designed in the form of a disk, roll or web. The decorative elements are inserted into apertures in the template, preferably by vibration, in such a way that the side of the elements which are provided with the fusion adhesive coating come to lie in the template. The visible sides of the decorative elements are then brought into contact with the auxiliary backing which consists preferably of an adhesive plastic foil. The auxiliary backing with the decorative elements adhering thereto is lifted off the template and is brought into contact with the backing in the form of a wide-mesh net, preferably under pressure, at a temperature at which the fusion adhesive is activated. This causes the decorative elements to be fixed preliminarily on the backing, the fusion adhesive penetrating in whole or in part through the mesh of the net. Final fixing is effected by placing the decorative elements on the articles to be embellished and, in so doing, the activating temperature of the adhesive must be attained. During final fixation the fusion adhesive penetrates completely through the mesh of the net.

Instead of employing an auxiliary backing in the form of an adhesive plastic foil, the auxiliary backing used can also be a second template with apertures, known as a reversing plate, to which the elements are transferred in a laterally reversed manner. Alternately, a vacuum means can be used as the auxiliary backing, by means of which the elements are lifted off the template and supplied to the backing.

If the elements in the template come to lie such that their side coated with the fusion adhesive does not lie in the template, the elements can be brought into contact with the backing directly.

It is possible to manufacture the decorative materials in a continuous operation.

It is also possible to provide the decorative elements with a coating of the fusion adhesive only after this is in contact with the auxiliary backing.

BRIEF DESCRIPTION OF THE DRAWING

The invention will be explained in detail in the following with reference to the drawing, in which:-

DESCRIPTION OF THE PREFERRED EMBODIMENT

Figure 1:
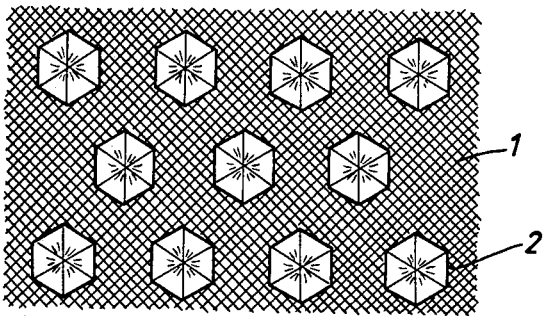
FIG. 1 is a top view of a decorative element.

The decorative elements 2 shown in FIG. 1 are arranged in the form of small rhinestones in a pattern on a thin, wide-mesh net-like backing 1 and are joined thereto or affixed thereon by means of a fusion adhesive coating.

Figure 2:
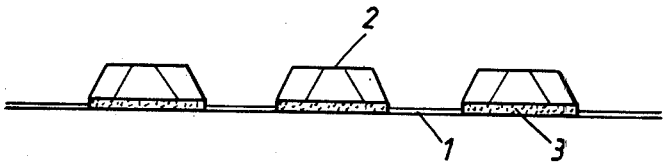
FIG. 2 is a side view of a decorative element.

The fusion adhesive coating 3 which penetrates in part through the mesh of the backing 1 is shown in FIG. 2.

Figure 3:
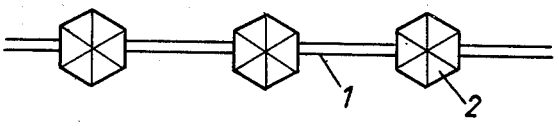
FIG. 3 is a top view of another embodiment of a decorative element.

FIG. 3 depicts an embodiment in which the backing 1 consists solely of two parallel threads to which the decorative elements 2 are affixed by a fusion adhesive coating.

Figure 4:
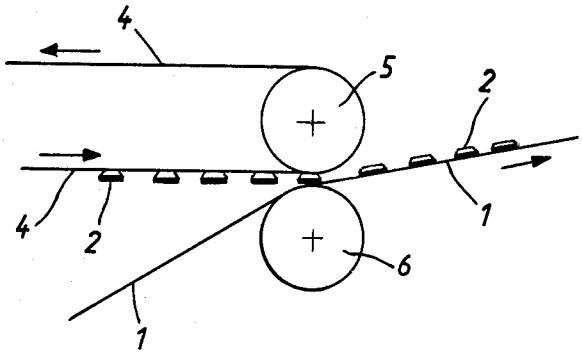
FIG. 4 is a schematic illustration of the process for producing said decorative elements.

FIG. 4 illustrates a preferred process for producing said decorative material. The decorative elements 2 are arranged in a pattern on an auxiliary backing 4 which has the form of a web, which is coated with an adhesive and which travels continuously around the roller 5. The backing 1 is supplied continuously through the nip between rollers 5 and 6. The rollers are of elastic material, e.g. rubber, and a temperature prevails at which the fusion adhesive is activated. Due to the prevailing temperature as well as the pressure exerted by said rollers, the decorative elements supplied on said auxiliary backing are fixed on the backing 1. The web-shaped decorative material, which is manufactured in a continuous operation, can be made available for use either in the form of a web or separated into discrete ornaments. The auxiliary backing 4 travels constantly in a closed system.

The decorative elements in accordance with the invention are suitable for many different applications, in particular for adorning and embellishing textiles and articles of clothing.

What is claimed is:

1. A decorative composite material for application to a substrate such as textile, comprising:

a thin, open mesh, net-like backing layer, for example tulle;

decorative elements larger than the mesh size of the backing layer each secured to said backing layer by a respective individual heat activatable adhesive layer, said adhesive layer penetrating at least partially through said backing layer;

said backing layer being thermally stable at the activating temperature of said adhesive;

whereby said composite material can be applied to a desired substrate by reactivating each thermally heat activatable adhesive layer to cause the adhesive to completely penetrate the mesh-like backing layer and to contact an underlying substrate.

2. A decorative composite material for application to a substrate such as a textile, comprising:

a thin, open mesh, net-like backing layer, for example tulle;

decorative elements larger than the mesh size of the backing layer each secured to said backing layer by a respective individual heat activatable adhesive layer, said adhesive layer penetrating at least partially through said backing layer;

said backing layer being thermally stable at the activating temperature of said adhesive;

a substrate layer, said backing layer and decorative elements being contiguous to said substrate layer and adhered thereto by said adhesive layers in thermally activated condition;

said adhesive layers penetrating said backing layer between each decorative element and the substrate layer.

3. A process for making composite decorative material for application to a substrate such as a textile, comprising:

applying a heat activatable adhesive layer to one side of a plurality of decorative elements;

applying said decorative elements to the surface of a thin, open mesh, net-like backing layer that is thermally stable at the activating temperature of the adhesive, said decorative elements being applied in a decorative pattern by heat activating each adhesive layer and causing the adhesive layer to penetrate said backing layer at least partially therethrough;

whereby said composite material can be applied to a desired substrate by reactivating said thermally heat activatable adhesive layer to cause the adhesive to completely penetrate the mesh-like backing layer and to contact an underlying substrate.

4. A process for making composite decorative material for application to a substrate such as a textile, comprising:

applying a heat activatable adhesive layer to one side of a plurality of decorative elements;

applying said decorative elements to the surface of a thin, open mesh, net-like backing layer that is thermally stable at the activating temperature of the adhesive, said decorative elements being applied in a decorative pattern by heat activating each adhesive layer and causing the adhesive layer to penetrate said backing layer at least partially therethrough;

bonding said decorative elements and said backing layer to a substrate layer by bringing the backing and substrate layers together and further heat activating the adhesive layers so that the latter completely penetrates the backing layer and become adhered to the substrate layer.

* * * * *